US010460918B2

(12) United States Patent
Hughes

(10) Patent No.: US 10,460,918 B2
(45) Date of Patent: Oct. 29, 2019

(54) FORMING ION PUMP HAVING SILICON MANIFOLD

(71) Applicant: ColdQuanta, Inc., Boulder, CO (US)

(72) Inventor: Steven Michael Hughes, Louisville, CO (US)

(73) Assignee: COLDQUANTA, INC, Boulder, CO (US)

( * ) Notice: Subject to any disclaimer, the term of this patent is extended or adjusted under 35 U.S.C. 154(b) by 94 days.

(21) Appl. No.: 15/948,465

(22) Filed: Apr. 9, 2018

(65) Prior Publication Data

US 2018/0233338 A1 Aug. 16, 2018

Related U.S. Application Data

(62) Division of application No. 14/466,711, filed on Aug. 22, 2014, now Pat. No. 9,960,026.

(60) Provisional application No. 61/902,665, filed on Nov. 11, 2013.

(51) Int. Cl.

| | |
|---|---|
| ***H01J 41/14*** | (2006.01) |
| ***H01J 41/18*** | (2006.01) |
| ***F04B 37/14*** | (2006.01) |

(52) U.S. Cl.
CPC ..... *H01J 41/14* (2013.01); *F04B 37/14* (2013.01); *H01J 41/18* (2013.01)

(58) Field of Classification Search
CPC ..... F04B 37/14; H01J 41/14; H01J 41/18
See application file for complete search history.

(56) References Cited

U.S. PATENT DOCUMENTS

| | | | | |
|---|---|---|---|---|
| 3,460,745 | A * | 8/1969 | Lamont, Jr. | H01J 41/20 417/49 |
| 8,439,649 | B2 * | 5/2013 | Rutherford | H01J 41/20 313/231.01 |
| 2002/0185947 | A1 * | 12/2002 | Schulte | F04B 17/00 313/7 |

* cited by examiner

*Primary Examiner* — Moshe Wilensky
(74) *Attorney, Agent, or Firm* — Clifton Leon Anderson

(57) ABSTRACT

An ultra-high vacuum (UHV) system includes a UHV cell and an ion pump to maintain the UHV in the UHV cell. The ion pump has a GCC (glass, ceramic, or crystalline) housing. An interior wall of the ion-pump housing serves as an anode or bears a coating that serves as an anode. At least one cathode is disposed with respect to the housing so that it can cooperate with the anode to form an electric field for establishing a Penning trap. The GCC housing defines a flow channel that extends radially through the anode so that a molecule can flow directly into the most ionizing region of a Penning trap.

1 Claim, 11 Drawing Sheets

FORMING ION PUMP HAVING SILICON MANIFOLD

This application is a divisional of copending U.S. patent application Ser. No. 14/466,711 filed 2014 Aug. 2, which claims priority based on U.S. Provisional Application No. 61/902,665 filed 2013 Nov. 11.

BACKGROUND

Cold and ultra-cold matter physics (e.g., optical traps, magneto-optical traps (MOTs), ion traps, laser cooling, and Bose-Einstein Condensates) has spurred demand for compact high vacuum (HV) and ultra-high vacuum (UHV, e.g., from about $10^9$ torr to about $10^{13}$ torr) systems. At these pressures, the mean free path of a gas molecule is on the order of 40 kilometers (km), so gas molecules typically collide with chamber walls many times before colliding with each other. For this reason, almost all interactions take place on chamber walls and other surfaces within a UHV chamber.

Several vacuum technologies may be used together to establish UHV. For example, a UHV cell may be baked at high temperatures to release particles prior to establishing UHV. Various pumping technologies can be used to establish UHV. However, UHV can degrade as particles are introduced intentionally (e.g., as part of an experiment) or unintentionally (e.g., by effusion from or diffusing through vacuum cell walls), so an active pumping technology is needed to maintain UHV. Ion pumps are currently the most desirable and mature technology for actively maintaining UHV in a compact cell.

Herein, "ion pump" refers to any system that removes mobile molecules (including single-atom molecules) from a local (incomplete) vacuum by: 1) ionizing the molecules to yield ions; and 2) immobilizing the ions by sorbing (adsorbing or absorbing) them to a "getter" material. Herein, "molecule" refers to the smallest particle in a chemical element or compound that has the chemical properties of that element or compound. A typical ion pump makes use of a Penning trap constituted by: an electric field and a magnetic field. The electric field gives rise to free electrons at a cathode and accelerates them toward an anode. A cross product of the magnetic field with the current associated with the accelerating electrons produces a force orthogonal to the electron path. This force diverts the electrons so that they form a swirling cloud.

The resulting cloud of swirling electrons ionizes incident molecules, which are then accelerated by the electric fields so that they impact surfaces of getter material, to which the ions are adsorbed. In addition, some molecules, e.g., of hydrogen and noble gases, most significantly, helium, may be absorbed by the getter material. In a "sputter ion pump", getter material may be liberated ("sputtered") from the getter surface and then re-deposited, burying sorbed molecules and renewing the getter surface. In contrast to other common UHV pumps, such as turbomolecular pumps and diffusion pumps, ion pumps have no moving parts and use no oil. They are therefore clean, need little maintenance, and produce little or no vibrations.

Efforts are underway to make more compact UHV systems. UHV systems tend to be incorporated in other systems, the dimensions of which may scale with the size of the UHV system. Smaller UHV will enable the incorporating systems to be more portable and less expensive. However, it is a challenge to maintain the ion-pump effectiveness at smaller dimensions. Therefore, it has become increasingly important to minimize the barriers to pumping effectiveness in compact UHV systems.

PARTS LIST

Figure 1:
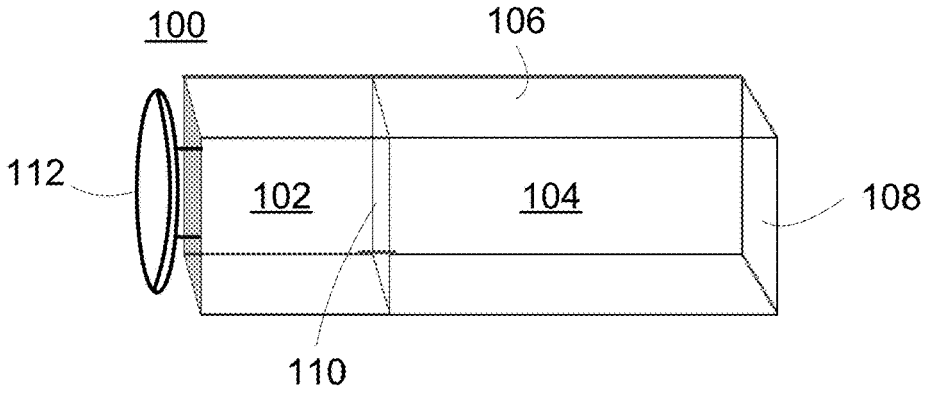
FIG. 1 is a perspective view of a UHV system in accordance with the invention.

100 UHV system
102 ion pump (wall-anode)
104 UHV cell
106 glass tube
108 atom chip

110 bonded end of UHV cell
112 flange mount
200 manifold
202 lower cathode
204 upper cathode
206 lower cathode contact ring
208 upper cathode contact ring
210 lower glass insulating spacer
212 upper glass insulating spacer
216 central aperture (of cathodes)
218 (lower) glass cap
220 (upper) glass cover
222 aperture in glass cover
224 sub-cathode
226 sub-cathode tip
228 housing interior
230 upper glass cap
232 anode coating
234 interior wall of housing
240 Penning-trap aperture
242 flow aperture
302 bottom square face
304 top square face
306 lower cathode port
308 upper cathode port
310 UHV-interface face
312 pump-out face
314 UHV-interface port
316 pump-out port
320 cylindrical wall
322 anode
402 spokes
404 concentric rings
406 arcuate slots
408 electric fields
410 slanted surfaces
412 incident helium atoms
414 reflected helium atoms
416 sputtered atoms
502 lower shadow-mask slot
504 upper shadow-mask slot
506 1 slot wall
508 u slot wall
510 1 slot base
512 u slot base
514 line-of-sight arrows
602 electric field lines
604 effective anode boundary
606 external magnets
608 (B) magnetic field
610 doped silicon walls
700 process
701 obtain GCC material
702 form cathode aperture+UHV chambers
703 coat aperture
704 slotted titanium cathodes formed
705 cathodes installed on ends of cathode aperture
706 magnets placed
707 cathode aperture sealed
708 ion-pump/UHV Cell assembly
800 Integrated UHV system
802 ion pump
804 UHV cell
806 housing
808 ion-pump aperture
810 UHV cell chambers
812 passage
814 glass caps
816 windows
900 UHV system
902 ion-pump aperture
904 chamber
906 chamber
908 chamber
910 housing
912 channel
914 channel
916 channel
918 ion-pump end
1000 suspended-anode UHV system
1002 ion pump
1004 UHV cell
1006 GCC housing
1008 suspended anode
1010 shaft
1012 shaft port
1014 UHV Cell port
1016 anode interior
1018 gaps
1020 cathodes
1100 ion pump
1102 magnetic fields for anode (magnet)
1104 magnetic anode
1106 cathode
1200 ion pump
1202 cathode
1204 anode
1206 shaft
1208 port cover
1302 magnetic field B
1304 electric field E
1400 UHV system
1402 housing
1404 UHV cell region
1406 electrode assembly
1408 UHV cell end
1410 atom chip
1412 ion-pump end
1414 GCC support
1502 slotted anode
1504 slotted cathodes
1506 cathode bracket structure
1508 anode bracket
1510 slots in anode
1600 ion pump
1602 blown-glass housing
1604 glass spacers
1606 titanium cathodes
1608 glass caps
1610 anode
1700 UHV system
1702 source cell
1704 UHV cell
1706 ion pump
1800 electrode assembly
1802 cathode
1804 ring anode
1806 impact wall
1808 array

DETAILED DESCRIPTION

In one common ion-pump configuration, a Penning trap is formed within a hollow interior of a cylindrical anode.

Molecules can enter the Penning trap via an axial end, e.g., top or bottom of the anode. However, entering through an axial end of the cylindrical anode may represent a detour to a particle that was approaching the cylindrical anode wall in a radially inward direction or other direction oblique to the anode's axis of radial symmetry. While it may have negligible impact on a large ion pump, such a detour can limit the effectiveness of a compact ion pump.

In the course of the present invention, consideration was given to providing a direct route for molecules exiting a cold cell to enter the Penning trap by forming a channel that extends through the cylindrical anode wall. However, there was a concern that forming the necessary hole through the anode wall would distort the electric field used to form the Penning trap. This could have an adverse effect on the formation of the Penning trap and the effectiveness of the ion pump.

Tests conducted in the course of the present invention have confirmed ion-pump effectiveness can be enhanced by providing a channel through a cylindrical anode wall, at least when certain conditions are met. These conditions include the presence of a conductive channel wall extending away from the anode interior. Under these conditions, the electric field in the cylindrical interior of the anode will be essentially the same as it would have been had there been no channel through the cylindrical wall. Therefore, a direct channel to the Penning trap can be provided without adversely affecting operation of the Penning trap. Because particles exiting a vacuum cell can enter the Penning trap directly rather than through some more circuitous route, the overall effectiveness of the ion pump is increased.

The present invention provides an ion pump with a wall anode formed of or on an ion-pump housing of GCC (Glass, Ceramic, or Crystalline) material. Herein, an "ion-pump housing" is a structure that at least substantially encloses a Penning-trap region; a Penning-trap region is a volume that would contain the swirling cloud of electrons when a Penning trap is established. Herein, a structure (e.g., the ion-pump housing) "substantially encloses" a region if the smallest convex shape that encloses the structure completely encloses more than half of the region.

Herein, an "anode" is an electrode that, when in use, is held at a higher electrical potential than another electrode (referred to as a "cathode") so as to establish an electrical field therebetween. Herein, a "wall anode" is an anode that is integrated into an interior wall of an ion-pump housing or that is formed (e.g., as a coating) on an interior wall of an ion-pump housing. Thus, a "wall anode" is contrasted with a "suspended anode", that is an anode that is spaced radially inward from and electrically isolated from an interior wall of the ion-pump housing that contains the suspended anode.

The diameter of a wall anode is equal to or substantially equal to the diameter of an interior housing wall; in contrast, a suspended anode has a diameter that is less than the diameter of an interior housing wall to ensure electrical isolation between anode and housing. Since the volume available to a Penning trap scales with the square of the anode diameter, a wall-anode design provides for a larger Penning trap than does a suspended-anode design, given the same housing interior dimensions. The larger Penning trap volume provides for more effective ion pumping for given housing dimensions, or, in other words, a more compact housing for a desired ion-pumping effectiveness.

In addition, the wall-anode design is more robust than the suspended-anode design. In a suspended-anode design, a distortion or malfunction of the suspension mechanism could short the anode to the housing; whereas, distortion of the wall in or on which a wall anode is formed is practically impossible and unlikely to cause a short. Furthermore, the suspension mechanism for a suspended anode typically occupies a port in the ion-pump housing; the wall-anode design allows this port to be eliminated or repurposed, e.g., as a pump-out port or a port for introducing molecules of interest to a UHV cell.

As stated above, use of a wall-anode design makes it possible to achieve a given level of pumping effectiveness using a more compact housing. In a compact housing design, even relatively brittle GCC material can be used while maintaining a high level of robustness. Accordingly, the ion-pump housing can be formed of a GCC material selected as a coefficient of thermal expansion (CTE) match with material used for a UHV cell. Thus, there is substantial synergy in the combination of a wall anode and a GCC housing.

In some embodiments, a GCC ion-pump housing is contact bonded or otherwise directly bonded to a UHV cell; in other embodiments, a monolithic GCC structure serves as a housing for both an ion pump and one or more UHV cells. In either case, the transitional structures used to connect metal housings to UHV cells (with transparent walls) are avoided. This leads to a more compact UHV system (UHV cell plus ion pump).

The use of GCC ion-pump housings has further advantages over metal ion-pump housings, at least for smaller designs. For example, crystalline silicon ion-pump housings can take advantage of mature photolithographic and semiconductor processing technologies for precisely defined active elements, conductive channels, and insulating structures. Similar advantages are available for other semiconductor materials, glasses, and ceramics. These and other features and advantages of the invention are apparent from the examples described below.

A UHV system 100 of FIG. 1 in accordance with the invention includes a GCC ion pump 102 bonded directly (as opposed to indirectly via a transition structure) to a UHV cell 104. UHV cell 104 has the form of an elongated rectangular parallelepiped with square ends. A low-CTE sodium borosilicate glass tube 106 with a square cross section defines four optically transmissive, elongated rectangular walls. One of the square ends is sealed with an atom chip 108, which provides active elements on a face toward the interior of UHV cell 104, as well as electrical access to the exterior of UHV cell 104 through atom chip 108. Atom chips are described in, for example, J. Reichel, "Microchip traps and Bose-Einstein condensation," Appl. Phys. B, 74, 469 (2002), the entire disclosure of which is incorporated herein by reference for all purposes. Such atom chips typically use currents in micro-fabricated wires to generate magnetic fields to trap and manipulate atoms. This chip approach allows for extremely tight confinement of the atoms and contributes to miniaturization of UHV cell 104 and of UHV system 100 overall.

UHV cell 104 is a cell for a magneto-optical trap (MOT). While UHV cell 104 of FIG. 1 has a particular design for a particular purpose, alternative embodiments of the invention may incorporate different UHV designs for similar and dissimilar purposes. In some embodiments, an ion pump is bonded to another object that is not a UHV cell. In most cases, a structural material to which an ion pump is bonded is a GCC material, including many optically transmissive materials, or other material with a CTE that is more easily matched with a GCC material than with a metal. In other embodiments, the ion pump may be a stand-alone device not (yet) bonded to a UHV cell or other device needing the services of an ion pump. In alternative embodiments, an ion pump and a UHV cell share a GCC housing.

The square end 110 of UHV cell 104 without atom chip 108 is fused or otherwise bonded directly to ion pump 102. Herein, "fused" refers to any process of permanently combining two materials, e.g., through some combination of chemical interactions, electrical fields, heat, and pressure. Herein, "bonding" refers to any means of permanently, for practical operational conditions, affixing one material to another. The mechanism for the affixing is referred to as a "bond". Care may be taken to ensure the components of the pump are properly protected, isolated, or passivated against exposure to gasses at high temperatures. Bonding and assembly may be performed in an atmosphere, with a gas flow, or even in a vacuum.

Suitable direct bonding methods include anodic bonding, thermo-compression bonding, electrostatically-assisted thermo-compression bonding, contact bonding, hydroxide-assisted catalyst bonding, and other hermetic UHV compatible methods including frit and silicate bonding. "Silicate bonding" is any technique that uses silicon oxide, aluminum oxide, or other glasses in precursor, dissolved or suspended states in a liquid solution, which, when applied between two glasses, ceramics, or crystalline materials, form a bond that is hermetic or capable of being made vacuum-tight after application. Herein, "anodic bonding" is the electrically-assisted contact bonding between glass and silicon. "Thermo-compression bonding" is contact bonding using heat and pressure. "Electrostatically-assisted thermo-compression bonding" is contact bonding using heat, pressure, and an electric field.

A flange mount 112 is disposed on ion pump 102 on a side of ion pump 102 opposite of the side bonded to UHV cell 104. This mount can be used to temporarily or permanently attach HV pumps or source devices.

Figure 2:
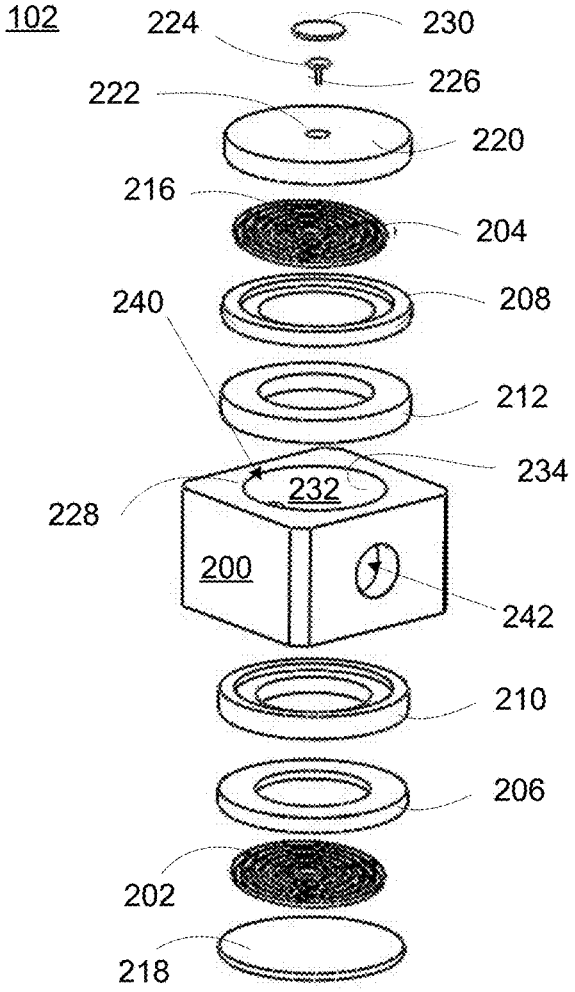
FIG. 2 is an exploded diagram of an ion pump of the UHV system of FIG. 1 and in accordance with the invention.

As shown in the exploded view of FIG. 2, ion pump 102 comprises a housing 200 (with an integrated anode), titanium cathodes 202 and 204, cathode contact rings 206 and 208, and glass insulating spacers 210 and 212. Cathodes 202 and 204 are formed with central apertures 216. Glass insulating spacers 210 and 212 insulate the cathodes 202 and 204 and cathode contact rings 206 and 208 from housing 200. Spacers 210 and 212 are bonded to housing 200 (when ion pump 102 is assembled). An insulating glass cap 218 is bonded to insulating spacer 210 to form a hermetic seal enclosing cathode 202.

A glass cover 220 covers cathode 204. Cover 220 has an aperture 222 formed therein. A tungsten or silicon sub-cathode 224 or array thereof extends through this aperture 222 through aperture 216 of cathode 204. A tip 226 of sub-cathode 224 extends toward an interior 228 of housing 200. Herein, a "housing interior" is the volume, within a smallest, closed, convex three-dimensional shape that completely encloses the housing, not occupied by solid material of the housing itself.

A glass cap 230 covers sub-cathode 224, forming a hermetic seal. Caps 218 and 230 define boundaries of an ion-pump interior that includes housing interior 228 as well as volumes containing cathodes 202 and 204. Herein, "ion-pump interior" refers to the housing interior plus any volume between glass caps 218 and 230 not hermetically sealed from the housing interior. A conductive metal wall-anode coating 232 may be formed on an interior wall 234 of housing 200. In an alternative embodiment, springs are used to press cathodes against cathode contacts to better ensure electrical contact.

Housing 200 is basically a rectangular parallelepiped silicon monocrystal with apertures 240 and 242 cored or otherwise machined therethrough to define a manifold. Example dimensions are: anode diameter 10 mm-30 mm (e.g., 19 mm), anode length 10 mm-30 mm (e.g., 17 mm), outer housing dimension of the block of silicon 20 mm*20 mm*10 mm to about 30 mm*30 mm*30 mm (e.g., 25 mm*25 mm*17 mm). Length from end cap to end cap is roughly 30 mm or less. There can be at least 2 mm, preferably 3 mm linear spacing, along the surface of the glass standoffs or insulators between the anode body and the silicon or conductive cathode rings that the cathode plates sit in. This is dictated by the breakdown voltage in air of 1-5 kV drive voltage, depending on the design, roughly 1 mm/kV. Changing the diameter of the parts, such that the glass part protrudes out a bit, or has external baffles decreases the necessary thickness of the glass insulator to insulate the cathode plates to the anode body.

Figure 3:
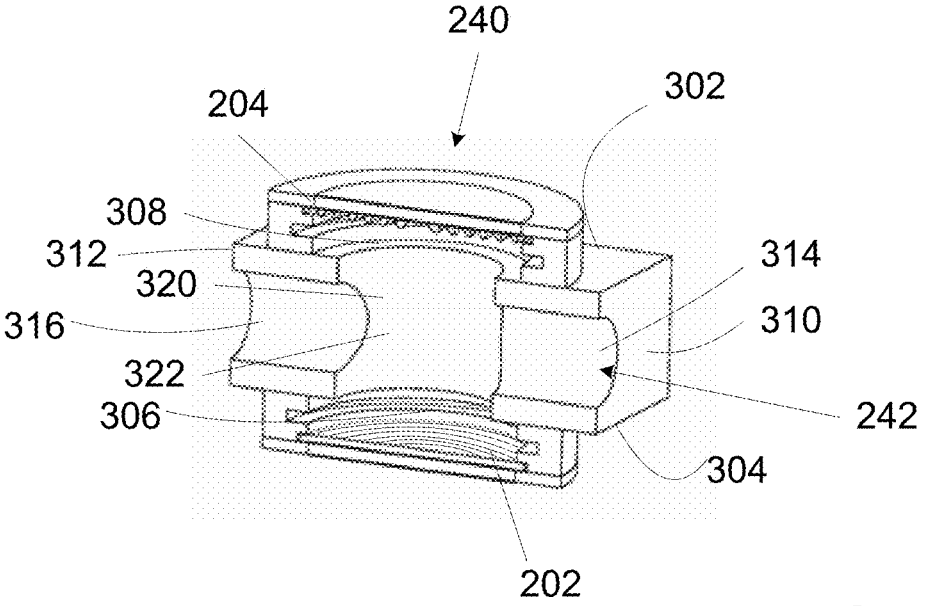
FIG. 3 is an isometric sectional view of the ion pump of FIG. 2.

As indicated in FIG. 3, "Penning-trap" aperture 240 (within which a Penning trap is to be established) has a relatively large diameter. It is formed between square faces 302 and 304 of housing 200 to define "cathode" ports 306 and 308 (where cathodes 202 and 204 are to be respectively located). Relatively small-diameter flow aperture 242 is formed between opposing rectangular faces 310 and 312 to define a cell-interface port 314 and a pump-out port 316. Cathodes 202 and 204 are positioned near opposing ends of Penning-trap aperture 240, i.e., at respective ones of cathode ports 306, 308. Rectangular face 310 mates with UHV cell 104 (see FIG. 1), so that cell-interface port 314 serves as a passage between the interior of UHV cell 104 and housing interior 228.

Rectangular "pump-out" face 312 can mate with a vacuum and other equipment used to maintain/refresh ion pump 102 and UHV cell 104 during maintenance cycles. Providing a pump-out port on the ion pump obviates the need for such a pump on a manifold or main body of an incorporating HV system. Also, including the pump-out port on the ion pump is advantageous as the ion pump is one of the most critical components to clean thoroughly during vacuum processing to ensure lowest attainable pressures after the cell has been sealed and detached from the processing station.

Cathodes 202 and 204 are slotted such that incident non-ionized molecules may fly through, while incident ionized molecules bounce off at angles that allow them to pass through the cathodes. Molecules that pass through the cathodes may be buried against glass cap 218, glass cover 220 (FIG. 2), and other structures of or attached to ion pump 102 (FIG. 1). The slotted cathodes thus can achieve stronger noble gas pumping, e.g., to aid in the removal of helium and improve conductance.

Figure 4A:
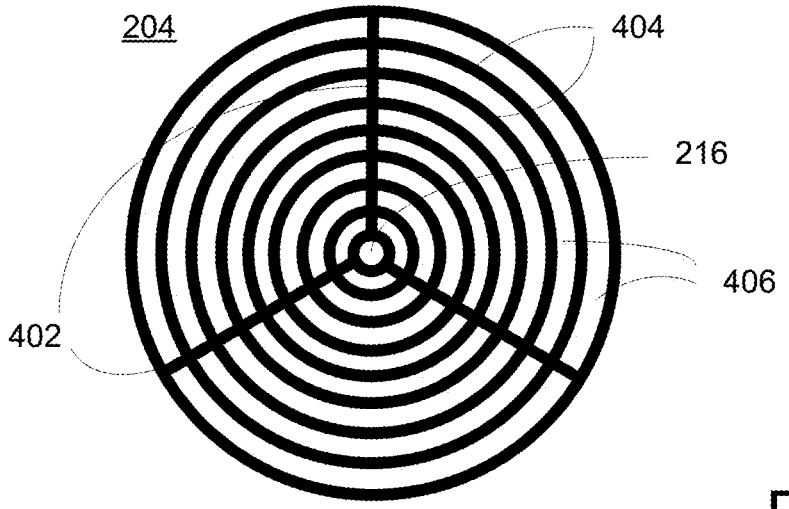
FIG. 4A is an enlarged isometric view of a slotted cathode of the ion pump of FIG. 2.

As shown in FIG. 4A for cathode 204, each cathode 202, 204 has three spokes 402 supporting concentric rings 404 to define arcuate slots 406. Slotted cathodes 202 and 204 can be formed via 3D printing of titanium, which 3D printing can achieve precisions under 100 μm. In an alternative embodiment, solid (non-slotted) titanium disks are used to achieve a higher pumping rate for "getterable" species, i.e., species that can be readily ionized and removed by a getter material. In another embodiment, one cathode is slotted while the other is a solid disk. Methods of slotting employed may also include standard machining methods.

Figure 4B:
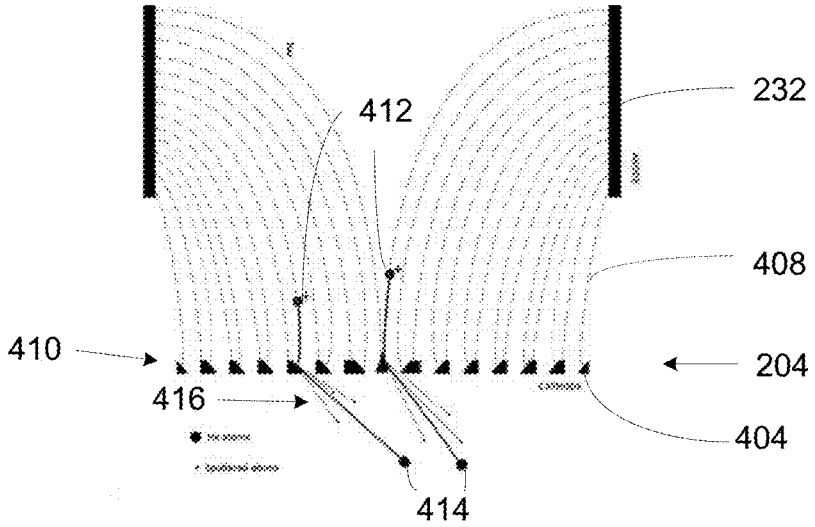
FIG. 4B is a schematic view of the ion pump of FIG. 2 showing the angled features of the slotted cathode of FIG. 4A and their effect on incident molecules.

Electric fields 408, shown in FIG. 4B generate electrons at the cathodes and accelerate them toward the anode. However, the electrons typically do not have sufficient energy to ionize helium and other noble gasses. Accordingly, as shown in FIG. 4B, radially inward surfaces 410 of rings 404 are slanted to improve glancing incidence for noble gas pumping. Incident helium atoms 412 and other noble-gas atoms can bounce off slanted surfaces 410 to yield reflected helium atoms 414, as well as sputtered atoms 416.

As shown in FIG. 3, cylindrical wall 320 of housing 200 and Penning-trap aperture 240 serve as an anode 322 for ion pump 102. To this end, the silicon of housing 200 as well as conductive cathode feedthrough rings 206 and 208, can be doped to increase their conductivity. Typically, the doping is performed before the silicon is machined to define apertures.

During operation, titanium of cathodes 202 and 204 may sputter and be deposited on wall 320, and to a lesser extent on ports 314 and 316, to form a conductive coating that may be more conductive than the doped silicon of the underlying wall 320. The increased conductivity can enhance the effectiveness of ion pump 102 in removing particles and maintaining a UHV. To achieve the benefits of higher conductivity at the outset, wall 320 can be coated with metal, e.g., titanium, platinum, etc., upon manufacture or at some other time prior to use.

Figure 5:
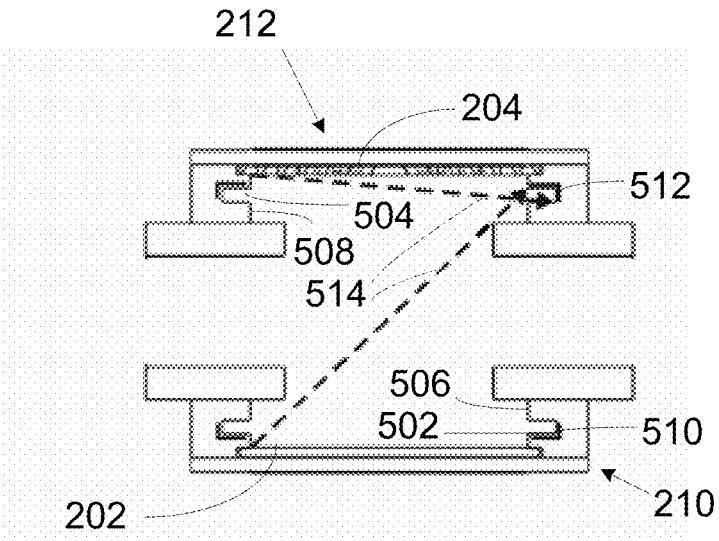
FIG. 5 is a schematic view of the ion pump of FIG. 2 illustrating a principle of operation of shadow-mask slots in insulating spacers of the ion pump.

To prevent shorting of the anode 322 to cathodes 202 and 204 due to deposition of sputtered titanium onto insulating spacers 210 and 212, shadow-mask slots 502 and 504 can be formed in the radially inward walls 506 and 508 of insulating spacers 210 and 212, as shown in FIG. 5. Shadow-mask slots 502 and 504 effectively define shadow masks precluding line-of-sight access from cathodes 202 and 204 to the bases 510 and 512 of shadow-mask slots 502 and 504 so as to prevent sputtered titanium from coating shadow-mask slots 502 and 504, as indicated by line-of-sight arrows 514, shown in FIG. 5. To reduce dendrite growth, all inner surfaces of mask slots are rounded by thermal and/or mechanical means, e.g., including melting, etching, and "sanding" operations. Note that each spacer 210, 212 can be formed by bonding two or more pieces to facilitate definition of slots 502 and 504. Alternatively, slots can be machined into monolithic spacers.

During operation, anode 322 (FIG. 3) is typically held at a potential difference of +1 kV to +10 kV from cathodes 202 and 204. This potential difference may be achieved by holding anode 322 (and, thus, ion-pump housing 200) at ground, and applying −1 kV to −10 kV to cathodes 202 and 204.

Figure 6:
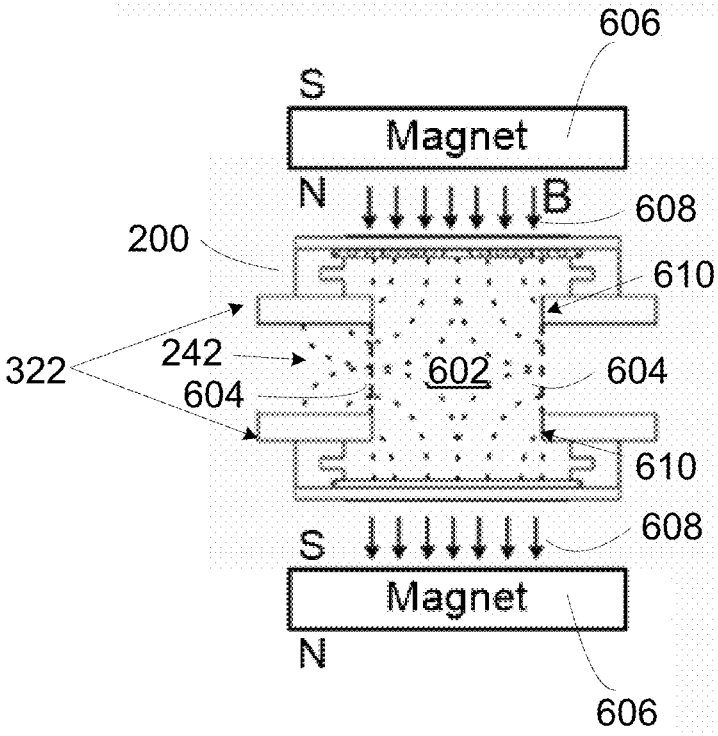
FIG. 6 is a schematic view of the ion pump of FIG. 2 showing electric and magnetic field lines that define a Penning trap.

The resulting electric field lines 602 are shown in FIG. 6, given conductive walls for flow aperture 242. Electric field lines 602 define an effective anode boundary 604 where flow aperture 242 extends through anode 322, demonstrating that the electric field (used to confine electrodes axially) at effective anode boundary 604 is substantially the same as it would have been if flow aperture 242 was not formed through anode 322.

Alternatively, a non-uniformly doped silicon housing can provide a conductive interior wall while the exterior housing wall serves as an insulator. In that case, the anode can be held at a positive potential and the cathodes held at ground. Also, as shown in FIG. 6, external magnets 606 can be used to generate the magnetic field B 608 required to radially confine electrons of the Penning trap.

Sub-cathode 224 (FIG. 2) extends through the central aperture 216 of cathode 204 to assist in "priming", i.e., startup of the Penning trap. Sub-cathode 224 operates as a "cold cathode", i.e., it does not rely on external heating to provide a thermionic emission of electrons. In an alternative embodiment, the sub-cathode is operated as a hot cathode.

Cold cathodes work by focusing the electric field to a point on a material with a low work function and hardness such as tungsten. Sub-cathode 224 has a sharp tip 226, on the order of a few micro-meters, so that electrons boil off of sub-cathode 224 at a high rate due to field focusing. In an alternative embodiment, an array of emitter tips replaces the single sub-cathode emitter tip for higher emission currents.

While a sub-cathode may be placed anywhere to improve ionization rates, inserting it in the center of the cathode structure as a needle point helps to ensure that all liberated electrons contribute directly to the Penning-trap electron cloud by the longest lived near-axial path. Accordingly, sub-cathode 224 protrudes through cathode aperture 216 of cathode 204, and, during operation, is held at or pulsed at a voltage more electrically negative than the voltage at which cathodes 202 and 204 are held.

Figure 7:
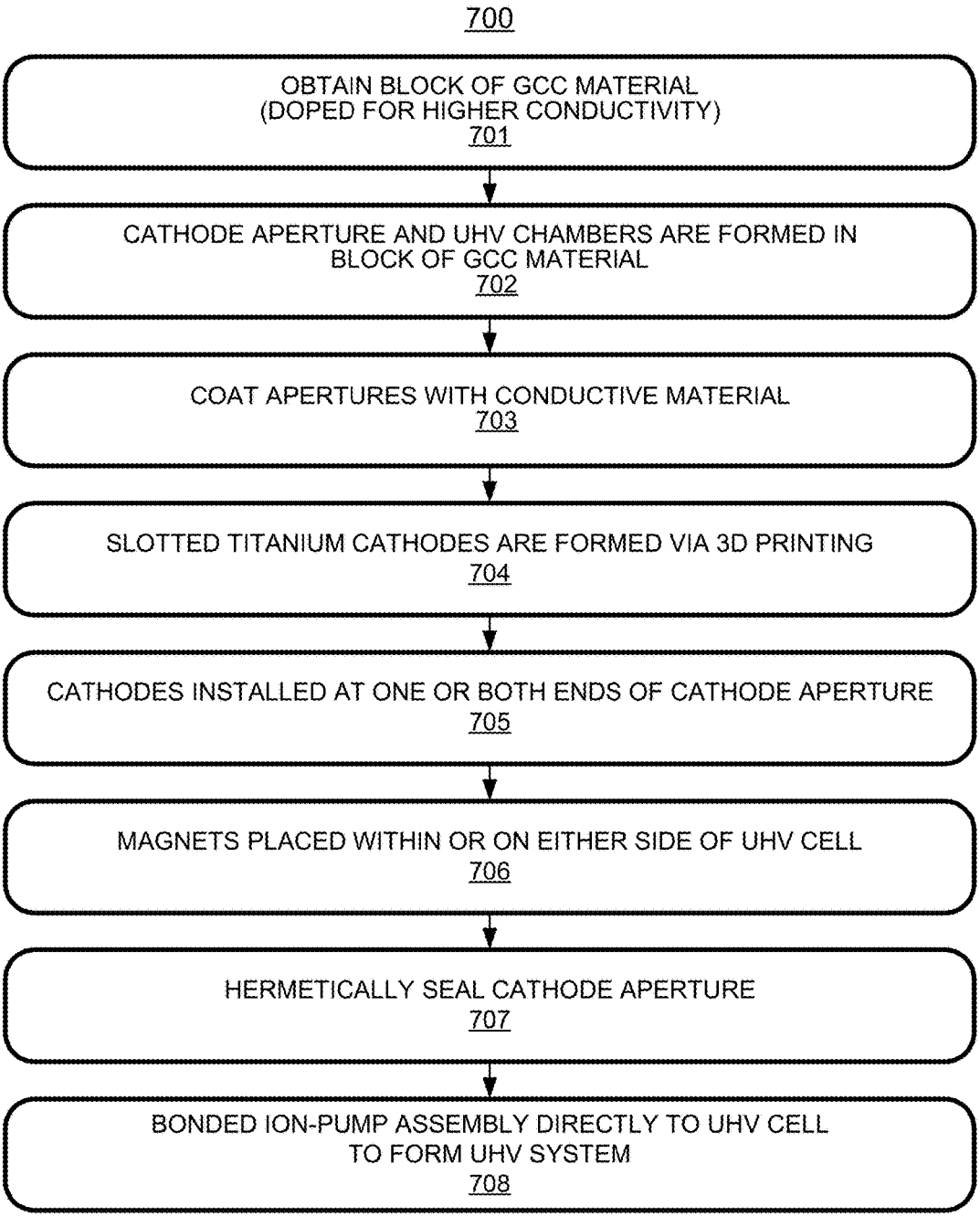
FIG. 7 is a flow chart of a process of making the UHV system of FIG. 1.

A process 700 of making a UHV system is flow charted in FIG. 7. At action 701, a block of GCC material is obtained. In some cases, the GCC is conductive or rendered conductive prior to the time it is obtained. For example, the GCC material may be crystalline silicon that was doped upon formation. Alternatively, the GCC may be rendered conductive after it is obtained. For example, crystalline silicon may be doped via ion implantation or thermal diffusion after apertures are formed.

At 702, a cathode aperture and UHV chambers are formed with the block of GCC material to define a manifold. At 703, at least one aperture wall is cleaned and coated for higher conductivity and to prevent oxide growth. At 704, slotted titanium cathodes are formed by 3D printing. At 705, Cathodes are installed at one or both ends of the cathode aperture. At 706, magnets are placed within or on either side of the UHV cell. At 707, the cathode aperture is hermetically sealed. At 708, the ion-pump assembly is bonded directly to the UHV cell to form a UHV system.

Figure 8:
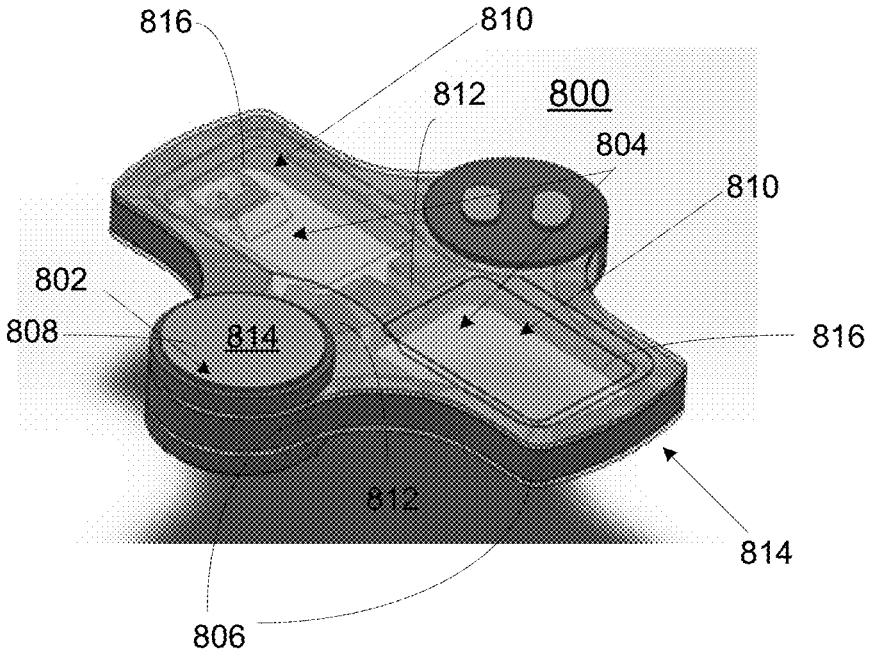
FIG. 8 is a perspective view of an integrated UHV system in which a monolithic GCC structure serves as both an ion-pump housing and a structural element of a multi-chamber UHV cell.

In the UHV system of FIG. 1, the ion pump is bonded to the UHV cell. In UHV system 800 of FIG. 8, an ion pump 802 and a multi-chamber UHV cell 804 share a housing 806. More specifically, a slab of monocrystalline silicon is machined to form an ion-pump aperture 808 and UHV-cell chambers 810. In addition, passages 812 are formed between ion pump 802 and UHV cell chambers 810 to permit fluid communication thereamong so that ion pump 802 can maintain chambers 810 at a UHV.

Cathodes are mounted near the ends of aperture 808, which are then hermetically sealed by direct-bonded glass caps 814. Transparent (sodium borosilicate glass, boro-aluminosilicate glass, or crystalline sapphire) windows 816 are bonded over chambers 810 to provide optical access to the chamber interiors. Exemplary glasses include the Corning Eagle line and the Shot af32 line.

Figure 9:
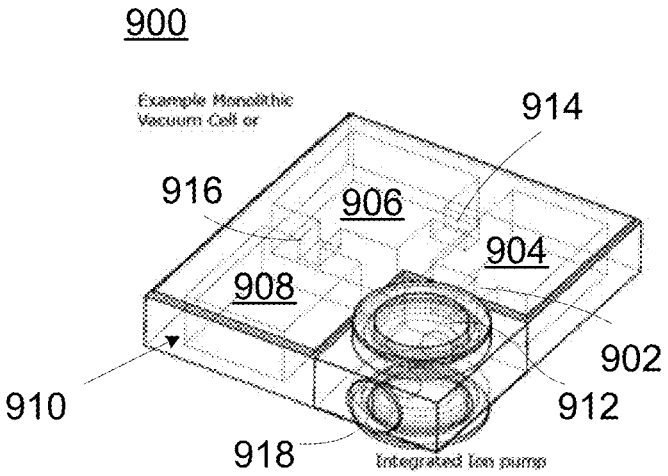
FIG. 9 is a schematic isometric view of a UHV system integrating the ion pump of FIG. 2 into a chamber of a multi-chamber UHV cell.

An alternative integrated UHV system 900 is shown in FIG. 9. In this case, an ion-pump aperture 902 and three UHV chambers 904, 906, and 908 are formed in a block of GCC material to form a housing 910, which is sealed at the ion-pump end 918. Channel 912 is formed between ion-pump aperture 902 and chamber 904, channel 914 is formed between chambers 904 and 906, while channel 916 is formed between chambers 906 and 908.

Some metal-housing ion-pumps employ a suspended anode, that is, a hollow cylindrical anode suspended within a cathode aperture without contacting the walls of the aperture. The suspended anode can be suspended from a shaft extending from the ion-pump exterior to the anode via a shaft port.

Figure 10:
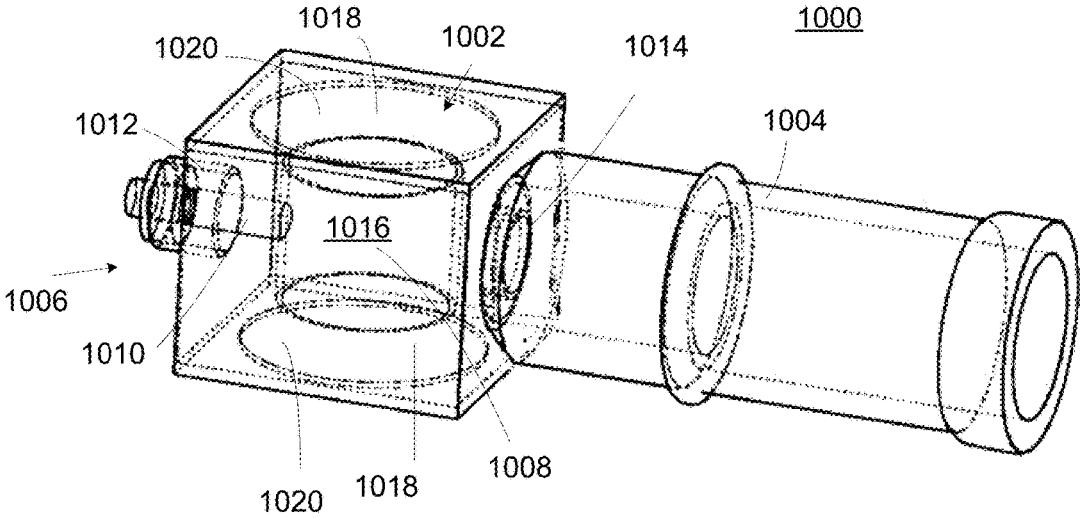
FIG. 10 is a schematic isometric view of a UHV system including a UHV cell and an ion pump employing a magnetic suspended anode in accordance with the invention.

Similarly, as shown in FIG. 10, a UHV system 1000 can include an ion pump 1002 and a UHV cell 1004. Ion pump 1002 includes a GCC housing 1006 with a suspended anode 1008 suspended from a shaft 1010 through a shaft port 1012.

Anode 1008 can be formed of steel. In a variation, a suspended anode is made of titanium to take advantage of titanium's gettering properties. Other examples use other anode materials, e.g., other metals.

In such a suspended-anode design, molecules exiting a UHV cell 1004 can travel through a cell port 1014 of housing 1006 to reach a Penning trap in the interior 1016 of suspended anode 1008 via gaps 1018 between suspended anode 1008 and cathodes 1020. An apparent advantage of the suspended anode is the provision of an unbroken cylindrical anode surface with well-characterized effects on electrical and magnetic fields.

However, in the course of the present invention, it was discovered that the presence of holes in an anode formed on a cathode-aperture wall did not significantly impair the Penning trap or the effectiveness of the ion pump. The electric field 602 and magnetic field 608 produced within housing 200 are shown in FIG. 6. Surprisingly, the basic form and function of the Penning trap is achieved despite the presence of flow aperture 242 through anode 322 (FIG. 3). To some extent this appears to be due to the conductive characteristics of the doped silicon walls 610 of flow aperture 242, which provide a cylindrical effective anode boundary 604.

More specifically, flow aperture walls that are conductive (e.g., due to doping or coating) to some minimum depth can result in an electric field within the anode interior that is essentially the same as it would have been without the channel through the anode. The conductive channel wall can extend 2 mm, 3 mm, or more from the anode interior; such a channel wall is readily achieved using a doped silicon block for the ion-pump housing. The channel may extend radially. Alternatively, the channel may extend in another direction that is more orthogonal to than parallel to the anode axis of cylindrical symmetry.

The flow channel through the anode wall allows molecules to flow directly into the portion of the Penning cloud that most effectively ionizes. Molecules that are not ionized are likely to bounce a few times, increasing the likelihood they will be ionized before they exit the ion pump.

On the other hand, using a wall anode such as anode 322 offers several advantages over a suspended-anode design. Firstly, no shaft is required to suspend the anode, allowing the aperture that would have housed the shaft to be used for another purpose, e.g., as a pump-out port.

Secondly, the use of the Penning-trap aperture wall as the anode maximizes the radial dimension available to the Penning trap; in contrast, a suspended-anode design limits the Penning trap to the lesser diameter of the suspended anode, which is spaced radially inward of the cathode aperture wall.

Thirdly, the availability of a path from the vacuum cell through the anode to the Penning trap obviates the need for open gaps between the cathodes and the anodes. This allows the gaps to be filled with insulators, e.g., glass insulating spacers 210 and 212, which reduces the chances of harmful arcing on the ambient outer wall with changes in atmosphere pressure, humidity, and other conditions. This in turn allows the gaps to be smaller so that the anode can extend closer to the cathodes. As a result, the Penning trap extends further axially in a wall-anode design as opposed to a suspended-anode design.

Therefore, in comparison with a conventional suspended-anode design, a wall-anode design, such as that employed by ion pump 102, provides for a Penning trap that extends further in both radial and axial dimensions. The resulting increase in the volume of the Penning trap results in a more effective ion pump for a given cathode-aperture volume. Alternatively, a given level of pumping effectiveness can be achieved with a more compact ion pump when the wall-anode design is employed instead of the suspended-anode design.

Certain examples include magnets within an ion pump's interior. For example, in a "magnetic-cathode-assembly" ion pump, magnets are disposed to the sides of cathodes facing away from the Penning traps; for example, end caps corresponding to end caps 218 and 230 can be of magnetic material or magnets can be inserted just beneath the end caps. In a "magnetic-cathode" ion-pump embodiment, the cathodes themselves are made of or include magnetic materials; the magnetic material can be embedded in titanium for additional robustness and to provide sputterable material.

In both the magnetic-cathode ion pump and the magnetic-cathode-assembly ion pump, the internal magnets are closer to the Penning-trap site than are the external magnets 606 used with ion pump 102. Therefore, a given magnetic field strength at the Penning-trap site can be achieved with weaker magnets. This can reduce requirements for magnetic shielding, e.g., to isolate UHV components from magnetic fields; in fact, the ion-pump housing and associated sealing caps can provide at least some shielding of the internal magnets. Thus, the use of internal magnets can reduce effective bulk by reducing the need for magnetic shielding as well as obviating the need for external magnets.

Figure 11:
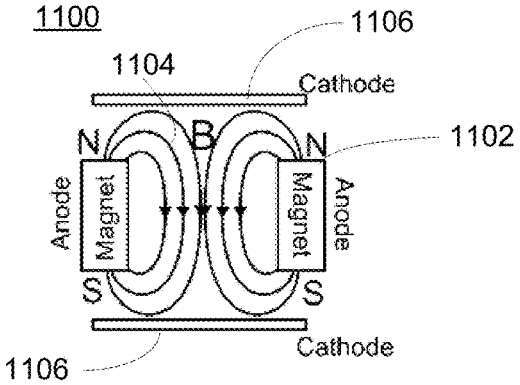
FIG. 11 is a diagram of magnetic field lines in an ion pump having a magnetic wall anode in accordance with an aspect of the invention.

Magnetic anodes can be used instead of or in addition to magnetic cathode assemblies to achieve magnetic fields required for a Penning trap without the use of external magnets. As shown in FIG. 11, for ion pump 1100, the magnetic fields 1102 produced by a magnetic anode 1104 are substantially axial in the region between cathodes 1106 occupied by a Penning trap.

In a suspended-anode design, such as that of ion pump 1002 in FIG. 10, the anode, e.g., anode 1008, can be formed of a conductive magnetic material, e.g., Series 1:5 samarium cobalt (SmCo5) magnets. Alternative rare-earth conductive magnets can include Series 2:17 samarium cobalt (Sm2Co17), and doped variants thereof, and neodymium-iron-boron (Nd2Fe14B). Some embodiments use non-rare-earth materials such as iron, nickel, and cobalt. In some embodiments, the magnetic anode material is coated with titanium or otherwise sealed so that the magnetic anodes do not contribute to the population of molecules that need to be removed to maintain UHV.

SmCo5 magnets have a very high coercivity, meaning they are not readily demagnetized. Some of the other (typically less expensive) magnetic materials may require re-polling (re-magnetization) of the magnet structure during and after high temperature cycling of the UHV system for bake out. Heating to typical vacuum bake-out temperatures, 100°-400° C. may be insufficient to de-poll and re-poll many strong magnetic materials. In fact, the temperatures required for re-polling may be well above temperatures that the housing can withstand. However, in a suspended-anode design, a vacuum thermally insulates the anode from the housing so that the anode can be heated (e.g., for repolling) substantially independent of the housing. Suitable heating methods can include one or more of the following: direct resistive current flow; radiative heating such as with a laser through the transparent housing; and inductive heating (since the GCC housing will minimally shield the anode compared to a steel housing).

In alternative embodiments, the conductive magnetic materials are also used as the main housing material and as a conductive coating for wall anodes. Other wall-anode embodiments use magnetic housing material or housing material modified to render the housing magnetic. In an embodiment, an epitaxial film of strontium-doped tin dioxide can be formed on an interior wall of a silicon housing. In alternative embodiments, the housing is fabricated of crystalline semiconductor materials that have been doped to render them magnetic; examples include manganese-doped gallium arsenide. Further embodiments employ ceramic ferrite magnetic housings, e.g., in housings that are otherwise similar to housing 200 of UHV system 100.

Figure 12:
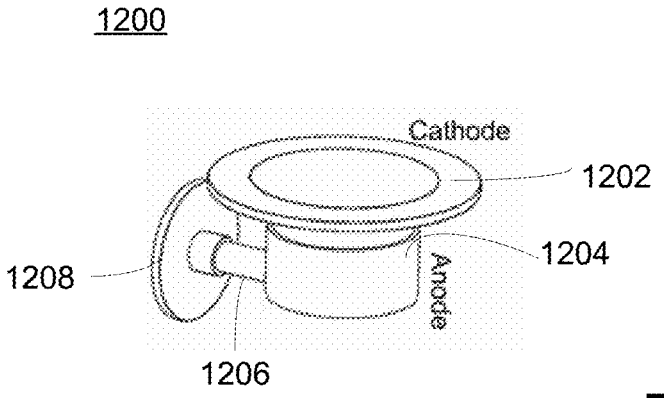
FIG. 12 is an isometric view of electrode components for an ion pump of a UHV system employing a split-cathode design in accordance with an aspect of the invention.
Figure 13:
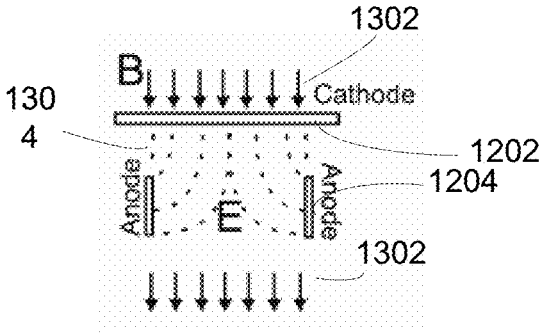
FIG. 13 is a schematic view of the electrode components of FIG. 9 showing the electric and magnetic fields produced thereby to implement a half-Penning trap.

FIG. 12 depicts an isometric view of ion pump 1200 (less the housing) implementing a "split-cathode" design in that only one cathode 1202 is used rather than the typical two cathodes. Ion pump 1200 further includes a non-slotted anode 1204 suspended from a shaft 1206. Shaft 1206 is attached at its non-anode end to a GCC port cover 1208, for hermetically sealing a shaft port of the ion-pump housing and insulating shaft 1206 from the housing. The vertical magnetic field 1302 and the radial (near anode 1204) electric field 1304 produced using split-cathode ion pump 1200 are shown in FIG. 13, which demonstrates the viability of the half-Penning-trap design.

Split-cathode ion pump 1200 provides for reducing ion-pump size by about half in exchange for reducing pumping speed by about half. In the course of the invention, it was shown that a Penning trap will operate with an anode half as long and a single cathode, albeit at a reduced efficiency. As a means of cutting pump size by half, this helps to mitigate the need for ever stronger magnets to maintain sufficient electron orbit times that are required in designs that decrease the diameter of the anode structure by half. Using monolithic GCC construction, it is fairly simple and, in some cases, advantageous to only mount a single cathode.

The most important factor in maintaining the Penning-trap electronic cloud is a magnetic flux that is parallel to the axis of the anode near the radial center of the anode. This can be achieved in a half-Penning-trap design in which the number of magnets in the cell can be cut from the typical two to one. As a result, magnetic flux can be reduced, which, in turn, reduces the shielding thickness required for comparable external field nullification. In one example, a single magnet is placed close to the anode end. In another example, field-focusing elements, e.g., incorporated into a magnetic shield, help collimate the magnetic field in the center of the anode.

Figure 14:
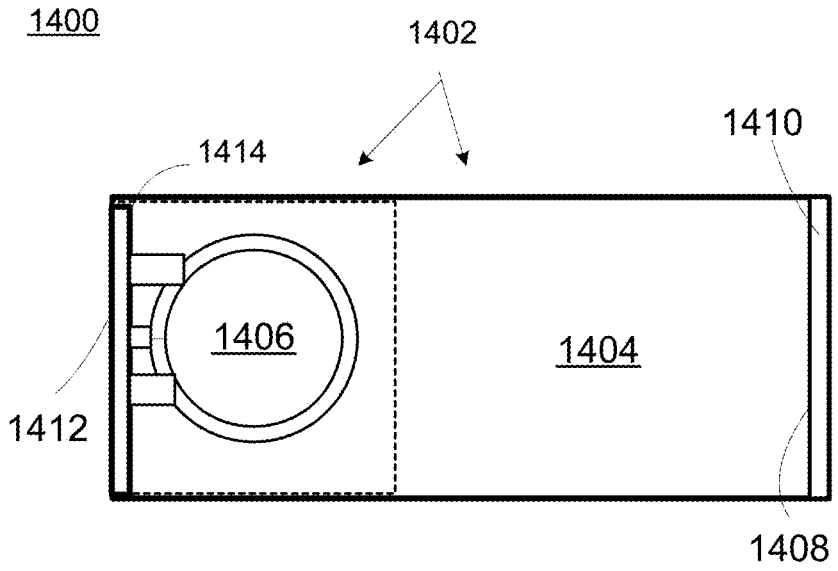
FIG. 14 is a schematic diagram of a UHV system in which a GCC housing encloses both a UHV-cell region and a plug-style ion-pump electrode assembly in accordance with an aspect of the invention.

An ultra-compact UHV system 1400, shown in FIG. 14, includes a monolithic borosilicate glass housing 1402 which encloses both a UHV cell region 1404 and a plug-style ion-pump electrode assembly 1406. Housing 1402 is sealed at the UHV cell end 1408 by an atom chip 1410. Housing 1402 is sealed at the ion-pump end 1412 by a GCC support 1414 of plug-style ion-pump electrode assembly 1406.

Figure 15:
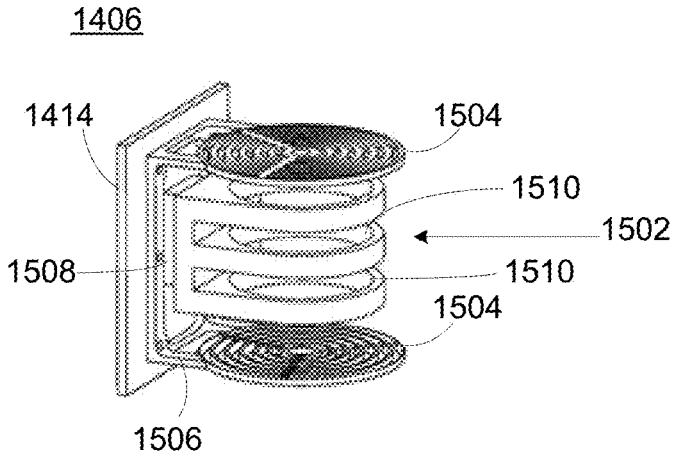
FIG. 15 is an isometric view of the plug-style ion-pump electrode assembly of FIG. 14.

As shown in FIG. 15, plug-style ion-pump electrode assembly 1406 includes support 1414, a slotted anode 1502, and a pair of slotted cathodes 1504. Slotted cathodes 1504 are both suspended from support 1414 by a cathode bracket structure 1506, which also provides electrical access to cathodes 1504. Anode 1502 is supported by an anode bracket 1508, which provides electrical access to anode 1502. Brackets 1506 and 1508 are mounted on support 1414. The slots 1510 in anode 1502 provide enhanced access by particles from UHV cell region 1404 to a Penning trap formed at the interior of anode 1502. In variants, a non-slotted anode and/or non-slotted cathodes are used.

In an alternative embodiment, a plug-style ion-pump electrode assembly employs a split-cathode design, i.e., uses only one cathode to produce a half-Penning trap. In alternative UHV system embodiments, a plug-style ion-pump electrode assembly is inserted into a UHV system component other than a UHV cell.

Ion-pump housings in accordance with the invention substantially enclose and protect at least the site of a Penning trap (i.e., the volume of the Penning trap when the ion pump is operational) as well as the Penning trap itself during operation of the ion pump; typically, the anode associated with the Penning trap is also substantially enclosed and protected by the ion-pump housing.

Ion-pump housings in accordance with the invention are at least 90% by mass of GCC (glass, ceramic, and/or crystalline) material. Non-GCC materials may be included, e.g., as coatings, dopants, electrical features, but only to the extent that, if they were somehow removed, the structural integrity of the housing would not be impaired. In other words, if all the non-GCC material were removed from the housing, the housing would still be a rigid structure that substantially enclosed and protected the Penning-trap site.

Depending on the embodiment, the GCC material or materials of an ion-pump housing may be transparent, partially optically transmissive, or opaque. Depending on the embodiment, the GCC material may be conductive, semi conductive, or non-conductive, e.g., insulating. Examples of GCC materials include borosilicate glass, ferrite (ceramic), and crystalline silicon.

The bulk material for ion-pump housing 200 is crystalline silicon. In other embodiments, the bulk material for the ion-pump housing can be a different GCC material, e.g., amorphous silicon, silica glass or another glass, or a ceramic material. Ceramic materials can be formed by sintering particles together, either initially in the form of an ion-pump housing, or in the form of manifold sections that are subsequently bonded together, or in the form of a block which is then abrasively machined to form the one or more housing apertures. Similarly, apertures can be formed in a block of glass to define an ion-pump housing. An additive process such as direct 3D printing or assisted growth processes of GCC materials, e.g., glass, may also be employed to build a substantial portion of the ion-pump housing.

Depending on the material, the pump housing or "manifold" (herein, a structure with one or more ports), may be reformed, reshaped, or machined from bulk. For example, abrasive machining of a bulk or molded material may be used to form one or more manifold ports. Alternatively, tubing or bulk material may be heated and reformed to define a manifold with one or more ports.

Figure 16:
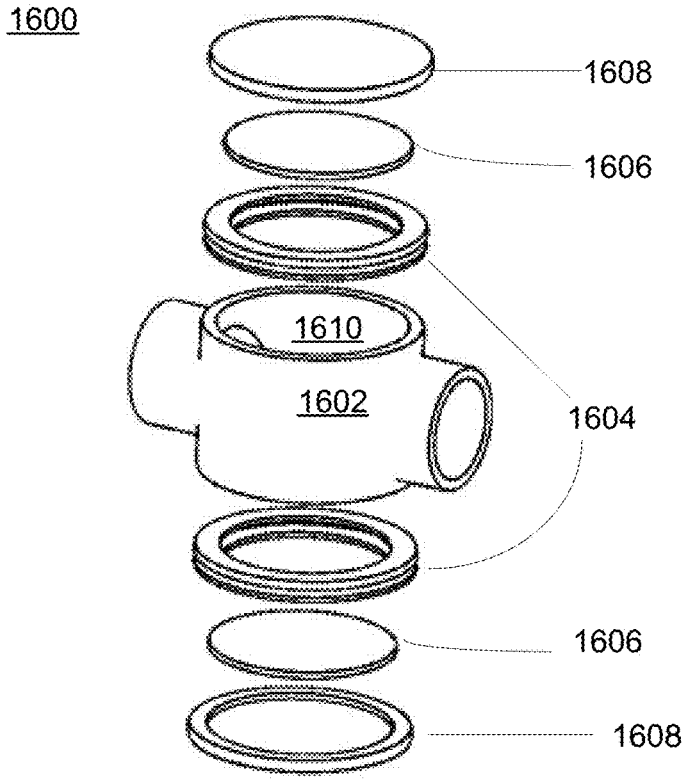
FIG. 16 is an exploded view of an ion pump with a blown-glass ion-pump housing in accordance with the invention.

Alternatively, glass-blowing techniques can be used to reform glass tubing into an ion-pump housing. For example, FIG. 16 is an exploded view of an ion pump 1600 with a blown-glass housing 1602, glass spacers 1604, titanium cathodes 1606, and glass caps 1608. An anode 1610 is provided by forming a conductive coating on an interior wall of glass housing 1602.

A conductive silicon ion-pump housing eliminates the need for a conductive layer to be deposited to form an anode, though a conductive coating may still be beneficial to optimize performance by reducing potential gradients along apertures in the anode wall. The conductive body can be held at ground and the electrically insulated cathodes can be held at negative high voltage for proper Penning-cell operation. Having silicon as the wall allows for a more uniform electric field on the anode, enables higher current operation for the ion pump without blowing out a conductive coating. The metal coating further helps to distribute a uniform electric field.

Silicon can also be used to form cathodes. One exemplary ion pump employs a simple design including a conductive silicon body, a glass shadow mask ring, and a silicon cathode. The silicon cathode can have a metal coating to help initial pumping or it can be bare silicon.

Another advantage of a silicon housing is that semiconductor processing techniques (e.g., photolithograph) may be used to form physical (e.g., slots, grooves, points, posts, spokes) and electrical (e.g., transistors, conductors, insulators) features. This can allow for, for example, electrical access from the exterior of a UHV system to the interiors of the ion pump and the UHV cell.

The use of a primarily silicon body, for example, is further advantageous as silicon has, by orders of magnitude, lower helium permeability than many compatible glass and ceramic candidates. This means integration in a low helium-permeability system is feasible without compromising the gas permeability of the vacuum chamber. Silicon is also compatible with certain low permeation type glasses such as some boro-aluminosilicate glasses, allowing for a lower average permeation chamber.

GCC materials such as aluminosilicate and boro-aluminosilicate may be used to reduce helium permeation compared to Pyrex, Legacy aluminosilicate such as the Corning 1700 line has limited or no production at present. However, other helium permeation characterized glasses such as Schott 8250 series are still in production in tubing form. This material may be cut and polished as is for part manufacture, or it may be reformed by a careful recipe wherein it is heated to a temperature between its annealing and melting point, referred to as a slumping temperature. By slotting a section of tubing, removing a 5° to 90° slit, the tubing can be flattened to a sheet without appreciably changing the thickness of the material.

If done on a lapped high temperature nickle alloy plate, or a known flat surface that has a higher melting point than the glass, and with an oxide, coating, or other surface features to prevent adhesion during the semi-molten state, sheets can be made that are very flat. As a result, less material needs to be removed during the optical repolishing of these faces prior to direct bonding to other materials. By this technique a well-characterized glass can then be direct bonded in laminate form to increase thickness, or be shaped to any shape desired to make UHV compatible low permeation glass components. Reforming typically requires heating to the slumping temperature, around 920° C. for 8253 glass, for at least a few minutes, then slowly cooling to the annealing point and holding to relieve strain in the material before cooling down to room temperature. Slumped sheets can then be polished as any other glass, and bonded as per many of the direct bonding methods mentioned above, as well as reflection coated.

In alternative embodiments, various several lines of boro-aluminosilicate based glasses developed by the display industry can be used. Some of these glasses are engineered with coefficient of thermal expansion rates that are directly compatible with silicon, such as Corning Eagle and the Schott AF 32 glasses. These are mass produced, typically with an optical polish that is already close to or within the specifications required for direct bonding. The primary drawback is they often have higher annealing temperatures and bonding temperatures than Pyrex, and are only available up to about 1 mm commercially. However, these too can be laminate bonded to create thicker stacks which may then be machined or processed to produce the parts desired.

While the alumina content is typically less than that of the Schott 8250 line, their permeation rates are typically at least an order of magnitude, if not several, superior to that of Pyrex. Combined with low-permeation coatings such as pure alumina controllably oxidized from aluminum depositions, these materials can provide an easily obtained, low permeation glass solution to UHV cell technologies. Anodic bonding temperatures are typically about 100° C. higher than that of Pyrex and longer bonding times, e.g., from hours to days are required for robust bonds to be established. Preferably, the bonding occurs in a vacuum or with an inert or forming gas to protect materials in the vacuum cell that may chemically react with air at elevated temperatures. In some cases, components are locally cooled with direct flow of such gasses. Bonding jigs can be configured to thermally and radiatively isolate components. Additionally, such glasses are typically harder and more scratch resistant than Pyrex; accordingly, they can be used to make machined parts as well as entirely direct bonded all glass boro-aluminosilicate glass cells with anti-reflective coatings.

Some boro-aluminosilicate glasses, such as Corning Eagle, may be direct laminate bonded to Pyrex, especially with thin Pyrex layers, allowing for low temperature anodic bonding and annealing of Pyrex, while still gaining at least an order of magnitude helium permeation reduction, depending on the ratio of the laminate face to the non-laminate face exposed to atmosphere. In this fashion, a composite laminate glass may be produced from which parts may be fabricated with even fewer inherent drawbacks due to the material properties.

Even the aluminosilicate materials such as Schott 8252 may be reliably direct or anodic bonded despite the CTE mismatch to silicon and vacuum processed at temperatures exceeding 300° C. This is accomplished by utilizing thin layers of at least one such material to improve compliance, for example a 1 mm to 1 cm diameter disc between 10 and 2000 μm thick of high conductivity silicon may be bonded to Corning 1723 glass and similar, providing a hermetic, low profile, robust electrical feedthrough.

Depending on the embodiment, an ion-pump housing in accordance with the invention may have zero, one, or more ports. For example, in an embodiment, a completed closed glass container can include both a UHV cell region and a plug-style ion pump. In other words, the "innards" of the vacuum pump are built in and housed by the vacuum cell. This would be similar to, but distinct from, UHV system 1400 (FIG. 14), in which two end ports 1408 and 1412 are respectively sealed by an atom chip 1410 and an electrode support 1414.

In general, for embodiments in which the ion-pump housing is separate from the UHV cell, there is at least one port, i.e., a "UHV port" for interfacing with the UHV cell. Suspended-anode UHV system 1000 includes a "shaft port" 1012 for shaft 1010 from which anode 1008 is suspended.

Figure 17:
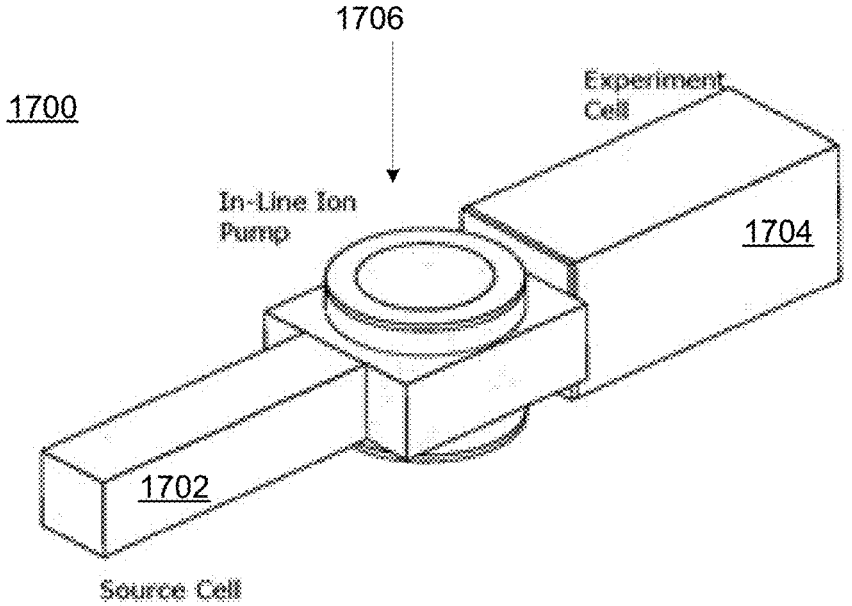
FIG. 17 is a schematic isometric view of a UHV system incorporating the ion pump of FIG. 2 bonded to a UHV cell and a source cell.

As shown in FIG. 17, a UHV system 1700 includes a source cell 1702 of particles that must be injected into a UHV cell 1704 through an ion pump 1706; in such a system, a source port can be defined, e.g., as the other end of the aperture used to define the VC-port. The Penning trap may be pulsed or otherwise operated intermittently so that the Penning trap does not interfere with the injection of particles in the vacuum cell. Magnetic and electric shielding and focusing techniques can be used to render "safe zones" through an ion pump through which injected particles in the vacuum cell may pass with minimal interference, or pumping, while undesired thermal or background molecules become ionized and pumped away.

In one embodiment, a suspended 1 mm diameter tube goes through, the center of the Penning trap, protecting a path of atoms, but otherwise minimally interfering with the trap. In one example, the tube extends axially through holes in the cathodes. In another example, it extends orthogonal to the axis of the anode, and through the very center of the anode to minimally interfere with the electron cloud. In a split-pump design, such a tube extends just past the anode and not between the anode and cathode.

Ion pump 102, FIG. 1, employs a full-Penning trap with cathode structures (cathodes and associated structural elements such as insulating spacers) that cover an opposing pair of "cathode" ports, defined by a single cathode aperture extending through the ion-pump housing. In alternative embodiments, there are no cathode ports and the cathodes are disposed within the housing. Half-Penning trap embodiments typically use only one cathode, in which case, there would be at most one cathode port.

Ion pump 102 includes a pump-out port for pumping out UHV system 100, e.g., initially and during maintenance cycles. In other embodiments, the vacuum system is completely sealed and/or placed completely within another UHV chamber for processing purposes. This will greatly improve the conductance during the vacuum processing and bake out before the final seal, or assembly, renders the target chamber an independent vacuum system. In such cases, there may be no need for a pump-out port.

Alternatively, such a through-port ion pump can be placed in-line with a cold atom system altogether replacing a manifold structure with an ion-pump manifold. Such an ion pump can be run in a pulsed operation firing during the down time of the vacuum system's primary operations, to maintain vacuum. Otherwise, the Penning cloud would likely interfere with the desired atoms or photons transported through the ion-pump manifold. A clear path can exist through the pump for the transport of atoms between chambers, though this path may be provided by a simple hole through the anode or cathodes. This configuration has the added benefit for low-pressure operation that the ion pump can use thermal atoms conducting between cells to help initiate low-pressure startup, especially if bonded near the aperture of a 2D MOT. However, care must be taken in the design to ensure that direct thermal spray from any aperture between cells does not have direct line-of-sight to the shadow structures so that condensed atoms, such as alkali metals, do not short out the ion pump or contribute to leakage currents.

Other ports may be used depending on the embodiment and application of the vacuum cell. Given a typical ion-pump housing with six faces, each of which can accommodate at least one port, the number of possible combinations of port types is quite large, providing flexibility to accommodate a great variety of UHV applications.

In some embodiments, the main body of the pump is glass with a cylindrical bore; a conductive layer or cylinder is applied or installed to the inner glass cylinder of the body to approximate the electrical behavior of a metal anode, while allowing the greatest conductance into the anode region. A single conductive loop or ring in the center of the effective anode with connecting cylinders or channels helps close the electric field to more closely approximate the classical Penning cell without said connecting cylinders or channels. Moreover, conductively coating not just the single inner cylinder, but also any connecting cylinder or channel to a sufficient distance from the "anode" results in a net field that again looks very similar to a standard cylindrical anode to the electrons in the cell, potentially removing the need for a loop to close the center of the Penning cell's electric flux.

During heated processing, such as anodic bonding, an inert or reducing gas can be used where the evaporated anode might otherwise oxidize in air. Such reducing agents as forming gasses allow a clean method of oxide removal to improve surface conductivity (compared to that of a surface oxide grown if exposed to oxygen or nitride growth if exposed to nitrogen). Alternatively, formation of oxides can be prevented using a removable protective layer or removed by active chemical means, e.g., a wet chemical or a dry plasma. Alternatively, bonding operations may occur in vacuum mitigating reactions with vapor species during such high temperature operations.

The entire cathode structure, including support and mounting features, can be 3D printed allowing the plug-style ion-pump design to be easily realized with or without bonding and fastening methods. 3D-printed cathodes can be fabricated in a clean environment with pure materials under UHV; more economically, a UV (ultraviolet) environment can be used. A clean environment can address the main drawback of 3D-printed titanium: the inherent porosity of 3D-printed parts due to their particle by particle fusion construction.

Pre-processing (of the cathode elements after their fabrication but before installation into an ion pump) is best achieved at high temperatures over 300° C., but below the melting of titanium or the 3D-printed metal, in a HV or UHV environment until pressures of 10-6 or lower are achieved at bake-out temperature. This pre-bake out helps migration of trapped contaminants and impurities to diffuse out and be pumped away. After pre-processing, the parts should be stored under vacuum, or at least in an inert environment. Where assembly requires high temperatures, care should be taken to choose either a high vacuum for assembly or a pure gas appropriate for the part so as not to pre-saturate it with atmospheric contaminants. Failure to process in a similar manner will ultimately limit the lowest attainable pressure of the ion pump as sputter events will result in more liberated contaminants. Mechanical rounding of points near the perimeter of the cathode structures can reduce the likelihood of dendrite growth over adjacent insulation structures.

During operation, cathodes can be heated to bring the cathode material to the point that the majority of the energy needed to liberate an electron is supplied thermally, again increasing the rate of electron evaporation. This may take the form of a wound tungsten coil, loop, or a simple point heated to several hundred degrees Celsius. Additionally, the hot or cold cathodes can be electrically isolated from the primary cathode structure acting as sub-cathodes. In this manner, a sub-cathode may be energized or turned on at potentials equal to or greater than the potential applied to the cathode with respect to the anode, to aid in startup or periodic maintenance just as with unheated cathodes. The sub-cathode may then be turned off or even reverse polled to a minor extent to repel ionized species from eroding or accumulating on the tip or filament. In a field ionization mode, it can be polarized more positively than the cathode to directly ionize species without electron bombardment. In a GCC ion pump, the electrical isolation necessary for an integrated hot or cold cathode is only marginally more complex and voluminous than a simple cathode design.

Cathode 202, FIG. 2, is of titanium, which is a sputterable (evaporable) getter material. In some embodiments, a conductive GCC (e.g., conductive silicon or conductive ceramic) can be used for the cathode. This can simplify ion-pump design and manufacture by obviating the need to contend with the higher CTE associated with titanium.

Another simple-to-fabricate embodiment reduces volume utilizing a hybrid approach combining the silicon anode and connected cathodes. This approach solves the sputter evaporation mask problem by using the cathode, suspended from a connected post, to mask the insulative glass that isolates the anode from cathode feedthrough. This design also is very scalable for practical fabrication. The cathodes can be fabricated as a single unit or combined from discrete parts though UHV compatible joining or fastening methods. Such methods may include spot welding, tungsten inert gas (TIG) welding (a.k.a., gas tungsten arc welding or "GTAW"), and press fits. A central axis of the pump can be offset to allow cooled atoms to conduct between cells without colliding with the structures. Regardless of use, by using a connected cathode structure such as this, the port typically reserved to fasten or mount a second or more cathodes may now be free as an empty port for other uses, such as pumping out, or sealed off for simplicity. Therefore the anode body or housing may have as few as two ports, one for the cathode structure mount, and one for connection to the rest of the cell. Through careful engineering, the number of ports on the body may even be reduced to one serving to both mount the cathode assembly, and through holes in its structure, allow for fluidic connection to the rest of the vacuum cell.

Embodiments of the invention employ a variety of technologies to assist low-pressure startup and operation in cases where the Penning-trap electron cloud cannot be reliably maintained based on ionization events alone. These technologies include: cold cathodes (as in system 100), radiation sources, UV stimulation, and non-evaporative getters (NEGs).

Cold cathodes work by focusing the electric field to a point on a material with a low work function and hardness such as tungsten. If the cold cathode has a sharp point, often on the order of a few micro-meters to a few nano-meters, electrons will boil off of the cathode at a higher rate due to field focusing. While the cold cathode can be placed anywhere to improve ionization rates, inserting one or an array thereof in the center of the cathode structure as a needle point helps to ensure that all liberated electrons contribute directly to the Penning-trap electron cloud by the longest lived near-axial path.

Some ion pumps with an insulative GCC housing allow for low-profile hermetic high-voltage feedthroughs to facilitate mounting and electrical connection of sub-cathodes in a Spindt-type configuration, though on a larger and more robust scale than typical Spindt or tubular type cathodes. The smaller tips may see erosion or have sputter covering them, but recessed below the cathode, the sub-cathode tip can be electrically shielded during the majority of the operation time and turned on when the electron cloud needs assistance with ionization events.

Furthermore, such sub-cathodes mounted with GCC-structured feedthroughs can employ a variety of commercially available tip technologies presently or to be released to the market without having to fundamentally integrate their assembly process into more than a single component of the pump. Therefore, tungsten tips, nanotubes, and SEM tips of all varieties are viable candidates for pump performance enhancement and a single GCC-pump design can accommodate them all.

In some embodiments, radiation sources assist low pressure startup by ionizing atoms via photon or radiation interactions with atoms in the vacuum that have yet to impact an electron from the Penning cloud. A small radioactive source can be inserted in the body of the pump so that the radiation from the source has line-of-sight to the area contained between the cathodes, especially the area contained within the anode. The slotted or integrated anode makes this significantly easier to achieve as the source may launch radiation directly into the Penning cell from the side. Alternatively, in place of a sub-cathode, a radiation source can be mounted in its stead again launching radiation directly into the Penning cell through a hole in the cathode plate.

In some embodiments, direct ionizing radiation may be wavelength tuned to specific species or molecules known to be present to directly ionize these molecules specifically thereby allowing the pumping of these as well as any molecules they may collide with while being accelerated toward a cathode or anode. Such radiation may be introduced directly through transparent GCC materials of the ion pump housing, or even through holes and ports in the anode or cathode to allow for direct access to the active pumping region of the pump. Such radiation may be tuned to known or introduced molecules such as rubidium, cesium, and other atoms intentionally injected for the scientific operation of the cells as their abundance will likely be higher than any other contaminant, and their background pressure control will be important to the operation of the UHV cell. Other wavelengths may be chosen in the visible, UV, IR (Infra-Red), and beyond, depending on the species to be ionized.

Some embodiments employ UV ionizing sources, e.g., diodes, lasers, lamps, and flash lamps, to inject light through the glass body or optical GCC components of the ion pump into the pumping region to ionize atoms and facilitate desorption of atoms sorbed to the walls in small pressure bursts to aid stuttering pumps. In this way, no modifications are needed to a glass-silicon or other GCC pump that has an effective "window" or component transmissive to the radiation. Furthermore, the ability to see light through the pump housing to view the discharge cloud allows for a visual indicator of vacuum quality and pump operation that is not practical in a steel pump with a continuous anode cylinder. Indeed, the spectrum of the ionization events serves as an indicator as to what is being pumped. Finally, an alternative means to assisting low pressure startup in smaller monolithic ion pumps is to install NEG's, or other "spewing" sources in line-of-sight of the ion pump, even mounting within the same housing.

A localized and brief high pressure burst can be sufficient to jumpstart a stuttering ion pump into full efficient operation. Such a burst can be achieved by heating an NEG, evaporable getter, or other source to briefly raise the background pressure. A combination of ionization arrays such as a Spindt cathode array outside the ion pump may serve a dual purpose of being used to jumpstart an ion pump, and during initial cell cleanout, ionizing of a "cleaning gas" such as argon to ion clean the vacuum system before final pump out and sealing.

Figure 18:
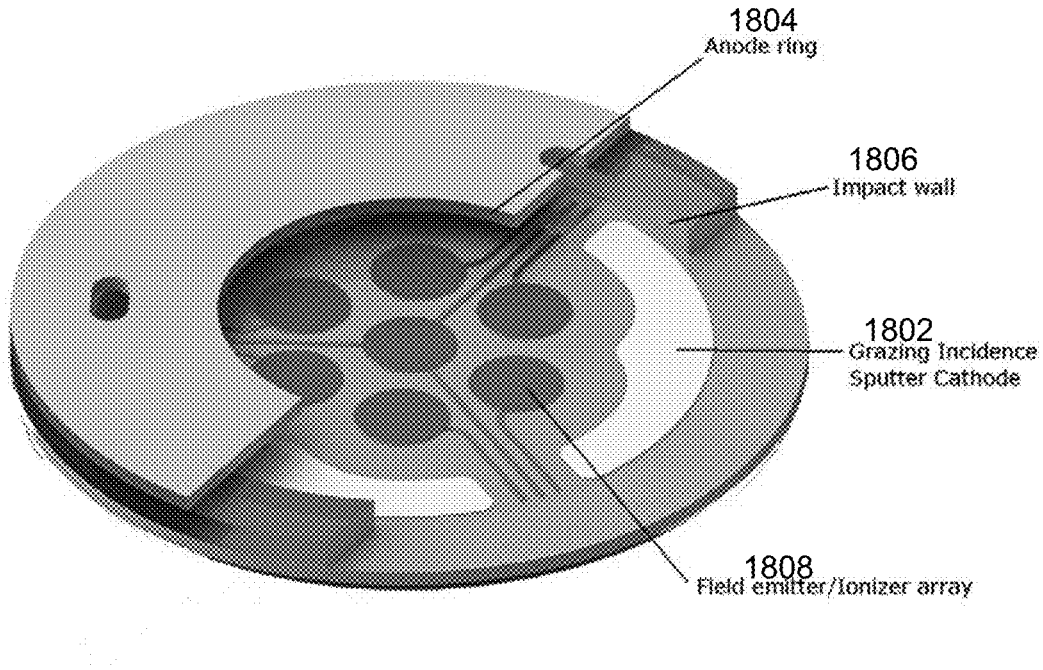
FIG. 18 is a perspective view of an electrode assembly for an ion pump including an ionizer array in accordance with an example.

An electrode assembly 1800, shown in FIG. 18, includes a cathode 1802, an anode 1804, and an impact wall 1806 that spaces the cathode from the anode. Cathode 1802 is a grazing incidence sputter cathode and includes an array 1808 of Spindt-type cathodes that serves as a field emitter and ionizer array. The array 1802 is arranged in a cell geometry that provides some degree of pumping with a minimal magnetic field. The Spindt-type cathodes can produce large numbers of electrons or field ionization events for low voltages by focusing the electric flux to the tip of a field emitter. With a weak magnetic field, the lifetime of these electrons can be prolonged as in a standard Penning cell, by increasing the path free electrons take as they approach the anode.

Electrode 1800 can be fabricated using isolated emitter arrays, to guard against burnout or shorting of the entire array. This central cluster of emitters creates electrons that are accelerated toward the anode ring 1804 at high fluxes. When they ionize a molecule, the resulting ion accelerates to the much more strongly negative poled sputter cathode at a grazing incidence. This encourages charge neutralization of noble gasses, and subsequent impact into the outer perimeter impact wall. Further, such events of sufficient energy lead to sputter that buries noble gasses and getterable gasses alike on the impact wall 1806.

The radial sputter ion pump geometry reduces back sputtering to the field tips which could short out the entire array. In an example in which the emitters are operated in reverse bias as field ionizers, a similar process still pumps out newly ionized molecules as they accelerate, bounce off of the sputter cathode, and bury into the impact wall. This impact wall serves an insulator between the cathode die and the anode ring, can be made of sodium borosilicate glass, or other highly resistive GCC materials such as Corning Eagle glass.

The anode in this case is a ring rather than a tall cylinder to provide a low profile electrode assembly and, thus, a low-profile ion pump. Rather than an ion cloud that hangs out due to magnetic "confinement", the field emitters produce orders of magnitude more electrons and without magnets. In some embodiments, the magnets and associated shielding are omitted. Once something is ionized, it is ideally accelerated toward the sputter cathode at a glancing incidence, sputters, and gets covered at the outer barrier wall to prevent or reduce liberation from subsequent impacts. Moreover, the geometry reduces sputter from shorting out the field emitters.

Herein, a "housing" is a structure that at least substantially encloses or is designed to at least substantially enclose functional components. An "ion-pump housing" is a housing that at least substantially encloses or is designed to substantially enclose a Penning trap; an ion-pump housing may also at least substantially enclose components used to implement a Penning trap.

Herein, a "housing interior" is a volume completely enclosed by a smallest convex shape containing the housing less the housing itself. A functional component is substantially enclosed by a housing if it is contained in the housing interior or is part of or formed on a wall of the housing that contacts the housing interior. "Ion-pump interior" refers to the interior of an ion-pump housing plus any volume in fluid communication with the housing interior, excluding the interior of an attached UHV cell.

Herein, "GCC material" encompasses glass, ceramic, and crystalline materials as well as composites of these materials; herein, "metal alloys" are not "GCC materials". Herein, "glass" refers to an amorphous oxide material that can undergo a transition between a hard and relatively brittle state into a molten or rubber-like state. Examples of glass include sodium borosilicate glass, alumino and boro-alumino silicate glass, other silica glasses containing at least 50%, by weight, silica, and alumina glasses containing at least 50%, by weight, alumina. "Ceramic" encompasses structures formed by sintering or otherwise bonding together particles of inorganic, non-metallic oxides (e.g., silica, alumina), carbides, borides, nitrides, and silicides. Herein, "crystalline" refers to a structure formed from a single crystal or "boule". The crystal may be an insulator such as zirconia, sapphire, or aluminum oxynitride, or a semiconductor such as silicon, germanium, gallium arsenide, or indium arsenside. GCC can further encompass any combination of the above; for example, GCC materials can include primarily a glass, but containing smaller crystalline regions in a semi-homogeneous fashion such as Zerodur® being an aluminosilicate glass with alumina crystals. Herein, "consisting predominantly of" means "at least 90% by weight".

Herein, an "electrode" is an electrically conductive circuit component used to make contact with a non-conductive circuit component. In the present context, the non-conductive circuit component is a UHV. Herein, "anodes" and "cathodes" are electrodes configured such that an anode has or can have a positive electrical potential relative to the electrical potential of an associated cathode, which has or can have a negative electrical potential relative to the anode. In the context herein, electrodes are designated "anode" or "cathode" according to the relative electrical potentials that must be applied to them to axially confine a Penning-trap electron cloud, while a sub-cathode or other such electrode may have a potential positive or negative relative to any previously established anodes or cathodes. Herein, "axial", "radial", and "circumferential" refer to three orthogonal dimensions of a cylindrical coordinate system in which "axial" refers to the direction of a magnetic field through a Penning trap used to confine the electron cloud "radially".

Herein, a "Penning trap" is a combination of magnetic and electric fields used to confine an electron cloud. Typically, a homogeneous axial magnetic field is used to confine electrons radially, while a spatially varying electric field is used to confine electrons axially. Herein, "particles" encompasses atoms, molecules, and ions. "Transparent", "transmissive", and "opaque" are defined, by default, with respect to visible light. However, if a light source of a particular wavelength or wavelength range (e.g., ultraviolet or UV, as well as gamma, Infra-Red (IR), and x-Ray) is mentioned, context may indicate that "transparent", "transmissive", and "opaque" are to be interpreted relative to the specified wavelength, wavelength range, or radiation type.

Herein, "three-dimensional (3D) printing" is an additive process of making a three-dimensional object by depositing material in successive layers. Herein, "getter" refers to a material included in a vacuum that has the innate ability to temporarily or permanently sorb chemically active species from vapor form in a vacuum, thereby removing them from the background pressure effectively pumping them from the system. Herein, "evaporable getter" refers to any getterable material intended to be evaporated onto a wall or surface in a vacuum to expose fresh sites for chemical adsorption. Herein, "non-evaporable getter" (NEG) refers to any getter material that is not to be evaporated, i.e., is to getter passively.

"Sputter" refers to an event wherein a collision by a free particle with sufficient energy causes one or more bound particles to become liberated. The liberation may be violent; the liberated particles typically fly by direct line-of-sight to impact and stick to a facing surface thus coating said surface.

"Low He permeable materials": Materials with helium permeation rates lower than borosilicate glass (at an operating temperature) by at least two orders of magnitude. Aluminum-oxide-based materials such as sapphire, Zerodur®, and alumino-silicate glass, as well as silicon crystal and many metals are examples of low He (helium) permeable materials. Zerodur® glass ceramic, made by Schott, is an anorganic, non-porous material, containing a crystallized phase and a rest glass phase. Zerodur® is made by a process of controlled volume crystallization.

Stable Penning operation occurs when the background pressure is sufficiently high to maintain a Penning discharge cloud of sufficient density as the mean free path for an atom incident upon the cloud has a high probability of electron collision and ionization, thereby contributing one or more of its electrons to the maintenance of the cloud and creating a sputter event that pumps gasses and also potentially contributes more atoms to the ionization events. Ion-pump instability occurs when pressure is so low that ionization events are infrequent enough that the electron cloud dissipates, terminating into the anode, at a rate higher than the ionization events. This ultimately leads to a depletion of the electron cloud and thus the pump becomes ineffective at further pumping until the cloud can be re-established. Ion-pump instability can be caused by a variety of factors including a low background pressure contributing atoms at an insufficient rate, conductive sputter or dendrites shorting the electrodes, insufficient magnetic or electric field strengths for Penning trap confinement, insulative or oxide layers formed over electrodes interfering with proper electric field generation, or misalignment of the magnetic field to the cell decreasing the electron lifetime in the cloud before anode termination.

Herein, "reformed" refers to any method of shaping or reshaping a material. The reforming method may involve high temperature, pressure, or chemicals. Herein, "growing" refers to any method whereby a chemical or a structure precursor is deposited, bonded, or otherwise permanently fused to an initial seed, scaffold, or base. The chemical or structure precursor may be in solution; the crystalline structure is often repeated based on the precursors present. The structure resulting from growing is said to be "grown".

"Machining" refers to any method of shaping and forming a complex shaped material from a simple bulk material. Machining may involve a mechanical removal, e.g., by cutting or grinding, but may include chemical removal, laser ablation, or a combination of the above. A structure resulting from machining is said to have been "machined".

Herein, "direct bonding" and "directly bonded" refer to bonding methods that do not require a transition structure. These terms encompass contact bonding methods, such as anodic bonding, as well as bonding using an adhesive layer, such as a "frit". Herein, "frit" refers to a mixture of silicon oxide, aluminum oxide, or other glasses and fluxes that are fused at high temperatures to make glass, but have lower melting temperatures than materials to which they are bonding.

Herein, a "vacuum cell wall" is any structure that defines a boundary between the inside, or vacuum side, of the vacuum chamber and the outside or ambient side of the vacuum chamber. Herein, an "ion pump" (also referred to as a "sputter ion pump") is a type of vacuum pump capable of reaching pressures as low as $10^{-11}$ mbar and beyond by ionizing gas contained within while employing a strong electrical potential, between 50V to 50 kV, which allows the ions to accelerate into and be captured by a solid electrode and/or its residue. Herein, "sorb" encompasses absorption and adsorption. In absorption, an absorbate fluid permeates or is dissolved by a liquid or solid absorbent. In adsorption, adsorbate particles adhere to the surface of an adsorbent. Adsorption is defined by the International Union of Pure and Applied Chemistry (IUPAC) as "Increase in the concentration of a substance at the interface of a condensed and a liquid or gaseous layer owing to the operation of surface forces."

Herein, all art labeled "prior art" is admitted prior art; all art not labeled "prior art" is not prior art. In the following claims, "said" refers to elements for which there is explicit antecedent basis, while "the" refers to elements for which the antecedent basis may be implicit. The foregoing embodiments, as well as modifications thereto and variations thereof, are within the scope of the following claims.

What is claimed is:

1. An ion-pump formation process comprising:

forming a silicon manifold by forming a Penning-trap aperture and a flow aperture in a block of monocrystalline silicon, the Penning trap aperture being formed between a first pair of faces of the silicon block, the flow aperture being formed between a second pair of faces of the silicon block;

coating walls of the Penning-trap aperture and the flow aperture with conductive material, the resulting coated wall of the Penning-trap aperture defining a wall anode;

positioning cathodes so that the wall anode is located between the cathodes; and hermetically sealing a volume including the cathode aperture and the cathodes.

* * * * *